United States Patent [19]

Becker et al.

[11] Patent Number: 4,567,098

[45] Date of Patent: Jan. 28, 1986

[54] METALLIZED PAPER AND METHOD OF ITS PRODUCTION

[75] Inventors: Franz-Josef Becker; Erich Hübner; Walter Lammerich, all of Bergisch Gladbach, Fed. Rep. of Germany

[73] Assignee: Zanders Feinpaiere AG, Fed. Rep. of Germany

[21] Appl. No.: 511,216

[22] Filed: Jul. 6, 1983

[30] Foreign Application Priority Data

Jul. 9, 1982 [DE] Fed. Rep. of Germany ..... 3225658

[51] Int. Cl.[4] ..... B32B 23/08; B32B 27/10; B32B 15/10; B32B 15/12

[52] U.S. Cl. ..... 428/327; 428/464; 428/511; 428/512; 428/537.1; 427/339; 427/350; 427/361; 427/362

[58] Field of Search ..... 428/511, 512, 537, 327, 428/464; 427/339, 350, 361, 362

[56] References Cited

U.S. PATENT DOCUMENTS

| | | | |
|---|---|---|---|
| 2,685,538 | 8/1954 | Stinchfield et al. | 428/512 X |
| 3,355,348 | 11/1967 | Lamar | 428/464 |
| 3,411,948 | 11/1968 | Reis | 428/464 X |
| 3,463,659 | 8/1969 | Dragoon et al. | 428/464 X |
| 3,714,107 | 1/1973 | Smith | 428/512 X |
| 4,207,222 | 6/1980 | Blum et al. | 428/512 X |
| 4,293,595 | 10/1981 | Kreiling et al. | 428/511 X |
| 4,363,851 | 12/1982 | Mishina et al. | 428/511 X |

FOREIGN PATENT DOCUMENTS 992320 5/1965 United Kingdom .

*Primary Examiner*—George F. Lesmes
*Assistant Examiner*—Nancy A. B. Swisher
*Attorney, Agent, or Firm*—Keil & Weinkauf

[57] ABSTRACT

Metallized paper whose metal layer has been deposited by evaporation in vacuo onto a cast-coated paper. The cast coating contains mineral pigments, latex binders and conventional additives, and at least 5 parts by weight of the pigment are a synthetic polymer pigment. The coating material has a pH value >7 and during the process of fabricating the metallized paper it is deposited in such an amount that, after the drying, 10–30 $g/m^2$ of cast coating are present. The coating material deposited onto a paper web is dried until its moisture content is 5–15% and the web is then pressed with the coated paper surface against a drum with a highly polished surface at a temperature of 100°–160° C. by means of a roll with a nip >1000 N/cm.

19 Claims, No Drawings

METALLIZED PAPER AND METHOD OF ITS PRODUCTION

The subject matter of the invention is a metalcoated paper, wherein the metal layer is deposited onto a cast-coated paper by direct evaporation, and a process of its production.

U.S. Pat. No. 3,113,888 teaches that a paper onto which an unpigmented coating made from a polymer latex, which forms a film not at room temperature but at a higher temperature, was deposited by means of cast coating, can be metallized directly. The polymer has a glass transition point ($T_g$) of 0°-93° C., and at 88° C. to 99° C. the layer becomes sticky under a light pressure.

According to a technique described in British Patent No. 992,320, a strongly adhering metal layer can be deposited onto a cast-coated paper without pre-enamelling by evaporation in vacuo, if the pigmented coating material for the cast coating has a pH value $<7$ and a polymer is contained therein as binder in an amount of at least 5 percent by weight, for the polymerization of which at least 8 percent by weight was used a acrylic acid or methacrylic acid relative to all the monomers.

These metallized papers, in which the metal layer was deposited directly onto a cast-coated paper, have not stood the test in practice because, despite the apparently smooth cast-coated surface, the necessary high gloss of the surface could not be achieved after the metal has been evaporated.

U.S. Pat. No. 3,463,659 teaches that it is necessary to pre-enamel highly calendered coated paper prior to evaporation of the metal in order to compensate for any surface irregularities that may still be present in the coating despite the calendering of the coated paper. The base coating of the paper contains 52–88 percent by weight of an inorganic pigment, 2–20 percent by weight of a thermoplastic pigment, 5–25 percent by weight of a soft polymer latex with a glass transition point ($T_g$) $<21°$ C., and 5–25 percent by weight of a natural water-soluble binder.

In his publication *Coating* 13–10, pp. 258–59 (1980) on metallized papers, O. Helgesson compared the direct metallization and the transfer metallization, and pointed out that the necessary pre-enamelling primer, even if high-quality enamelled papers are used, is a considerable disadvantage due to the environmental pollution caused by the solvents.

However, the process step of enamelling the paper surface prior to metallization is not only a costly additional step, but it also requires a higher pump capacity, because during evacuation from the coated and enamelled paper, solvent residues continue to evolve gases. Moreover, special precautionary steps must be taken in order to eliminate these solvents, because the formerly normal emission into the atmosphere is prohibited by the tightened legal regulations.

It is an object of the invention to create a metallized paper with a highly polished metal surface, for the metallization of which it is not necessary to pre-enamel the paper surface, which is provided with a pigmented coating and can be manufactured without difficulties in the plants normally employed for paper refining.

This object is achieved by the paper and the process set forth in the claims.

A surprising finding was that, contrary to the view continually expressed in the most recent literature, namely, that it is necessary to pre-enamel the paper surface prior to the direct metallization, it is possible to create a surface with a high gloss and a metallic character without pre-enamelling the paper surface with varnishes with an organic-solvent base.

The metallized paper taught by the invention, the metal layer of which is deposited onto a cast-coated paper by evaporation in vacuo has, if necessary, a pigmented layer beneath the cast coating that contains mineral pigments, latex binders, and conventional additives. It is characterized by the fact that the cast coating was made with a coating material having a ph $>7$ in an amount of 10–30 g/m$^2$, at least 5 parts by weight of the pigment contained in the cast coating being synthetic polymer pigment and on 100 parts by weight of pigment there are present 5–25 parts by weight of a film-forming binder.

Particularly suitable is a combination of 95–20 parts by weight of a mineral pigment with 5–80 parts by weight of a synthetic polymer pigment. A preferable combination is also 93–75 parts by weight of a mineral pigment with 7–25 parts by weight of a synthetic polymer pigment.

Preferably, the cast coating is present in an amount of 15–26 g/m$^2$; particularly preferred is a coating weight of 18–25 g/m$^2$. Coating amounts of 20–25 g/m$^2$ are likewise possible.

The invention also comprises the process of manufacturing a metallized paper with a highly polished surface wherein, if necessary, first a pigmented coating is deposited onto a paper and thereon a cast coating which contains mineral pigments, latex binders and conventional additives, followed by a direct evaporation in vacuo of a metal layer. This process is characterized by the deposition of an aqueous coating material having a pH value $>7$ and containing at least 5 parts by weight of the included pigments as a synthetic polymer pigment and, on 100 parts by weight of pigment, 5–25 parts by weight of a film-forming binder and other conventional additives, in such an amount that after the drying, 10–30 g/m$^2$ of cast coating are present, then drying the deposited material until its moisture content is 5% to 15% and, finally, pressing the coated paper surface against a drum with a highly polished surface at a temperature of 10020 C. to 160° C. by means of a roll with a nip pressure greater than 1,000 N/cm.

Particularly suitable is a processing technique using drum temperatures of 120° C. to 140° C.

The substitution of mineral pigments by so-called plastic pigments (syntetic polymers in particle form) is known in the art. Thus, West German Patent Specification Laid Open to Public Inspection No. 19 26 853 describes a paper coating material containing a pigment binder in an aqueous dispersion in which at least a portion of the pigment is present in the form of discrete spherical particles from a synthetic organic polymer. The polymer pigment is not film-forming under the conditions of coating and finishing. In U.S. Pat. No. 3,819,557 it is specifically stated that for a styrene-based polymer pigment an improvement of the opacity, whiteness, gloss, and printability can only be achieved if the glazing of the coating is effected through calendering below the softening point of the polymer pigment.

West German Unexamined patent application No. 26 03 155 describes a cast coating process in which a tough, porous coat is first produced which, after back-moistening, is then glazed against the hot chromium-faced cylinder. Therefore, water-plasticizable synthetic polymers are employed as binders that have a specific ratio of film-forming temperature $T_f$ to glass transition point $T_g$. The description indicates that the coating properties can be controlled by the simultaneous use of hard latexes having a $T_g > 45°$ C. Polymer pigments are mentioned among the pigments and in one example, a portion of the mineral pigment is substituted by a polystyrene pigment having an average particle diameter of 0.5 μm in order to increase the volume of the coating for a given coat weight.

Plastic pigments are offered by the relevant chemical industry in the form of stable, aqueous dispersions with average particle diameters of 0.1–30 μm of the plastic pigment in specified steps. In particular, plastic pigments whose average particle diameters is 0.1–1.5 μm have stood the test, and particle diameters of 0.5–1.0 μm are particularly preferred. The polymer pigments involved are polystyrene, styrene-acrylamide copolymers, graft copolymers from styrene and acrylic acid derivatives, terpolymers from styrene, acrylonitrile, and acrylic acid or their derivatives, polyvinyl chloride, polyvinyl chloride copolymers, polyvinyl acetate, polyvinyl acetate copolymers, homopolymers of olefins such as ethylene, propylene, copolymers of two or more olefins, copolymers of olefins with other monomers such as styrene or unsaturated carbonic acids, such as maleic acid and the like. The polymer pigments can also be used in mixtures. Apart from the thermoplastic polymer pigments, urea formaldehyde resins or melamine formaldehyde resins are suitable.

As a rule, the dispersions have a solids content of 40–60 percent by weight and are stabilized by means of suitable emulsifiers. The stabilizing auxiliary agents should be compatible with the conventional pigmented coating compositions to enable intermingling without complications.

However, coating compositions for the cast coating of paper have the property, under certain conditions, e.g., a high temperature or a pH value shift, to gelate and to solidify. The gelation conditions of the paper coating material are, however, to a large extent influenced by the stabilization agents of the plastic pigment dispersions, so that special precautions are necessary for the use of plastic pigments in cast coating.

A coating mixture is employed which can be spontaneously coagulated or gelated at and above a specific temperature without the necessity of a substantial water removal, e.g., by evaporation or penetration into the base paper.

Peptization and dispersion agents in the form of protective hydrocolloids, which can at the same time perform bonding functions, as well as in the form of polyelectrolytes as known in the prior art (e.g., polyacrylates, polyphosphates, citrates, tartrates), supported synergistically, if necessary, by the use of bi- or polyvalent metal cations, in combination with a likewise synergistically active suitable $[OH]^-$-ion concentration can be used in moderation alone or in combination with each other to produce the "ready-to-coagulate" condition of the coating composition.

It has been found that certain plastic pigments can also be used in coating compositions intended for the cast coating of paper alone or in combination with mineral pigments. A smaller, but also a greater, proportion of plastic pigment is possible, although among the conditions for cast coating the requirement that temperatures at which the plastic pigment softens be avoided is not fulfilled.

On the contrary, it has been proved to be appropriate to also add to the paper-coating material substances that soften the plastic pigments so as to lower the film-forming temperature of the combination binder and plastic pigments contained in the coating.

Conventional softeners such as dibutyl phthalate, dioctyl phthalate, epoxy softener and other substances that are suitable for softening synthetic polymers can be used as plasticizers in the coating material.

In cast coating, the partially dried paper coating is placed against a hot cylinder with a highly polished surface and pressed by means of a roll, during which process under the temperature and pressure conditions a plastification of the coating takes place, so that the surface is an image of the highly polished surface of the cylinder. By using a polymer pigment in the paper coating and using temperatures above the softening point of the polymer pigments and appropriate pressure, the cast-coated paper surface can be improved in such a way that direct evaporation of this surface is possible, resulting in a metallized paper with a high-gloss surface and a metallic character. This result is a complete surprise.

The addition of a plasticizer as such is not necessary, but the plasticizability of the coating can be improved by the use of softeners, so that with a given temperature and a given nip pressure as a result of the high plasticity of the coating, the web can attain a higher rate on the hot chromium-faced cylinder. The addition of softeners also enables one to select a lower temperature of the chromium-faced cylinder and/or to reduce the pressure applied to the web by the roll. Thus, owing to the composition of the cast-coating material, it is possible to adapt the actual cast-coating technique to the conditions in existing plants, so that the smooth and closed surface required for the direct metal evaporation is achieved.

Various metals such as aluminum, nickel, chromium, copper are suitable as metallization metals, but nobler metals, such as gold and silver, can also be deposited by vacuum evaporation in vacuo. However, aluminum, nickel or copper are used because of cost considerations.

The well-known oft-described plants are used for the direct metallization, during which the coating is deposited by condensing metal vapors that are produced in a high vacuum. The thickness of the condensate depends on the throughput time and metal evaporation capacity and is extremely small. Normally, coating thicknesses of 0.01–0.05 μm are expected.

The metal layer can also be covered with a protective layer, an ink layer, or a functional layer. Due to the absence of the enamel coating beneath the metal, the paper taught by the invention retains its paper character and properties, such as stiffness, and its behavior with regard to climactic fluctuations corresponds to that of paper. On the other hand, the enamel layer heretofore employed in the direct process as disclosed in the prior art alters the paper characteristics considerably, particularly the behavior in the plant. Also, the paper made in accordance with the principles of the invention can be printed better than pre-enamelled papers because the blocking enamel layer does not prevent the ink from drying quickly. When used as labels for bottles, the ability to be removed from the bottle in cleaning plants is greater than that of pre-enamelled papers, because the paper soaks more easily and rapidly.

EXAMPLE 1

First, a pigmented preliminary coating is deposited and dried on a web consisting of a base paper of conventional composition with a basis weight of 50 g/m$^2$. This basic lining with a coating weight of 8 g/m$^2$ has a conventional composition of 80–90 parts by weight of a mineral pigment and 10–20 parts by weight of a conventional binder such as polymer latexes, casein, starch, polyvinyl alcohol, or the like. Clay, calcium carbonate, zinc oxide, $BaSO_4$ serve as pigments.

By means of the cast-coating technique, a coating with the following composition is deposited onto this dried coating in the amount of 20 g/m$^2$ (after the drying):

| | |
|---|---|
| Water | 115 kg |
| Casein | 8 kg |
| Aqueous NaOH (25%) | 0.3 kg |
| $Ca(OH)_2$ hydrate | 2.4 kg |
| Commerical clay | 161 kg |
| Polystyrene plastic pigment (48% dry substance) | 59 kg |
| Binder latex (50% dry substance) | 41 kg |
| Optical brightener, liquid | 1.4 kg |
| Conventional lubricant dispersion, liquid | 5.4 kg |

The coating material deposited by means of conventional equipment is dried until its moisture content is 8% and is then pressed by means of a roll against a cylinder with a highly polished chromium-faced surface at a temperature of 150° C. using a roll with a nip pressure of 1,200 N/cm. The web rate is 150 m/min. The web, which is roll-fed by the chromium-faced cylinder, is rewound and is then provided with an aluminum layer in a vacuum metallizing plant.

The moisture content prior to metallization of the paper is 2.5%. After metallization, the moisture content is set at 6–7% through conditioning.

The paper thus obtained has a highly polished metal surface.

Instead of clay, other conventional pigments such as kaolin, $CaCo_3$, $BaSO_4$, ZnO, satin white, etc. can be used.

EXAMPLE 2

By means of the cast-coating technique a coating with the following composition in an amount of 25 g/m$^2$ is deposited onto a base paper of conventional composition and having a basis weight of 55 g/m$^2$:

| | |
|---|---|
| Water | 95 kg |
| Casein | 8 kg |
| Aqueous NaOH (25%) | 0.3 kg |
| $Ca(OH)_2$ hydrate | 2.4 kg |
| Commercial clay | 150 kg |
| Polystyrene plastic pigment (48% dry substance) | 104 kg |
| Binder latex (50% dry substance) | 41 kg |
| Optical brightener, liquid | 1.4 kg |
| Conventional lubricant dispersion, liquid | 5.4 kg |

The coating material deposited by means of conventional equipment is dried until its moisture content is 8% and is then pressed by means of a roll against a cylinder with a highly polished chromium-faced surface at a temperature of 150° C. using a roll with a nip pressure of 1,200 N/cm. The web rate is 150 m/min. The web, which is roll-fed by the chromium-faced cylinder, is rewound and is then provided with an aluminum layer in a vacuum metallizing plant.

The moisture content prior to metallization of the paper is 2.5%. After metallization, the moisture content is set at 6–7% through conditioning.

The paper thus obtained has a highly polished metal surface.

We claim:

1. A high gloss metallized paper whose metal layer is deposited onto a non-enamelled cast-coated paper by evaporation in vacuo, said paper having a cast coating containing mineral pigments, synthetic polymer pigments, latex binders and conventional additives and being characterized in that the cast coating is made with a coating material having a pH value $>7$ and is present in an amount of 15–30 g/m$^2$, that the cast coating contains per 100 parts by weight of pigments from 95 to 20 parts by weight of mineral pigments and from 5 to 80 parts by weight of synthetic polymer pigment and that for each 100 parts by weight of pigment there are present 5–25 parts by weight of a film-binding binder, said metal layer being directly on said cast coating.

2. The metallized paper according to claim 1, characterized in that 95–75 parts by weight of mineral pigment and 5–25 parts by weight of synthetic polymer pigment are contained as pigment in the cast coating.

3. The metallized paper according to claim 2, characterized in that the cast coating contains up to 25 percent by weight of plasticizers relative to the synthetic polymer pigment.

4. The metallized paper according to claim 2, characterized in that the synthetic polymer pigment is a polystyrene pigment, a graft copolymer from styrene and acrylic acid or acrylic acid derivatives, a terpolymer from styrene, acrylonitrile and acrylic acid or acrylic acid derivatives, a polyolefin-homo or copolymer or a urea formaldehyde resin with an average particle diameter of 0.1–30 μm.

5. The metallized paper according to claim 4, characterized in that the average particle diameter of the polymer pigment is 0.3–1.5 μm.

6. The metallized paper according to claim 4, characterized in that the cast coating contains up to 25 percent by weight of plasticizers relative to the synthetic polymer pigment.

7. The metallized paper according to claim 1, characterized in that the cast coating is present in an amount of 18–26 g/m$^2$.

8. The metallized paper according to claim 7, characterized in that the cast coating contains up to 25 percent by weight of plasticizers relative to the synthetic polymer pigment.

9. The metallized paper according to claim 7, characterized in that the synthetic polymer pigment is a polystyrene pigment, a graft copolymer from styrene and acrylic acid or acrylic acid derivatives, a terpolymer from styrene, acrylonitrile and acrylic acid or acrylic acid derivatives, a polyolefin-homo or copolymer or a urea formaldehyde resin with an average particle diameter of 0.1–30 μm.

10. The metallized paper according to claim 9, characterized in that the average particle diameter of the polymer pigment is 0.3–1.5 μm.

11. The metallized paper according to claim 9, characterized in that the casting coating contains up to 25 percent by weight of plasticizers relative to the synthetic polymer pigment.

12. The metallized paper according to claim 1, characterized in that the synthetic polymer pigment is a polystyrene pigment, a graft copolymer from styrene and acrylic acid or acrylic acid derivatives, a terpolymer from styrene, acrylonitrile and acrylic acid or acrylic acid derivatives, a polyolefin-homo or copolymer or a urea formaldehyde resin with an average particle diameter of 0.1–30 μm.

13. The metallized paper according to claim 12, characterized in that the cast coating contains 0–15 percent by weight, preferably 5–10 percent, of plasticizers relative to the synthetic polymer pigment.

14. The metallized paper according to claim 12, characterized in that the cast coating contains up to 25 percent by weight of plasticizers relative to the synthetic polymer pigment.

15. The metallized paper according to claim 1, characterized in that the average particle diameter of the polymer pigment is 0.3–1.5 μm.

16. The metallized paper according to claim 1, characterized in that the cast coating contains up to 25 percent by weight of plasticizers relative to the synthetic polymer pigment.

17. A high gloss paper as defined in claim 1, wherein the paper includes a pigmented coating beneath the cast coating.

18. A process of producing a metallized paper with a high-gloss surface, wherein there is deposited onto a paper, a cast coating containing mineral pigments, synthetic polymer pigments, latex binders, and other conventional additives, and then evaporating directly in vacuo a metal layer onto said cast coating, characterized by the deposition of an aqueous cast coating material having a pH value 7 and which contains per 100 parts by weight of pigments from 95 to 20 parts by weight of mineral pigments and from 5 to 80 parts by weight of synthetic polymer pigment and that for each 100 parts by weight of pigment 5–25 parts by weight of a film-forming binder is present in such an amount that, after the drying, 10–30 $g/m^2$ of cast coating are present, drying the coating until its moisture content is 5 to 15%, then pressing the coated paper surface against a drum with a highly polished surface at a temperature of 100° C. to 160° C. by means of a roll and a nip press 1,000 N/cm.

19. A process as defined in claim 18, wherein a pigmented coating is formed on the paper onto which the cast coating is applied.

* * * * *